US006848748B2

(12) United States Patent
Paschedag et al.

(10) Patent No.: US 6,848,748 B2
(45) Date of Patent: Feb. 1, 2005

(54) MINING SYSTEM WITH DRILLING, LOADING, CONVEYOR, AND SUPPORT

(75) Inventors: Ulrich Paschedag, Ascheberg-Herbern (DE); Harry Martin, Cranberry Township, PA (US)

(73) Assignee: DBT GmbH, Lunen (DE)

( * ) Notice: Subject to any disclaimer, the term of this patent is extended or adjusted under 35 U.S.C. 154(b) by 0 days.

(21) Appl. No.: 09/957,131

(22) Filed: Sep. 20, 2001

(65) Prior Publication Data

US 2002/0074849 A1 Jun. 20, 2002

(30) Foreign Application Priority Data

Sep. 20, 2000 (DE) ..... 100 46 497

(51) Int. Cl.[7] ..... E21C 35/18

(52) U.S. Cl. ..... 299/33; 299/43; 299/95; 299/19

(58) Field of Search ..... 299/13, 19, 33, 299/43, 95; 175/87, 315; 173/184, 46; 172/403

(56) References Cited

U.S. PATENT DOCUMENTS

| | | | | |
|---|---|---|---|---|
| 2,623,739 A | * | 12/1952 | Thomas et al. | 175/315 |
| 2,799,488 A | * | 7/1957 | Mandt | 299/13 |
| 3,856,356 A | * | 12/1974 | Allen et al. | 299/11 |
| 4,065,929 A | * | 1/1978 | Simpson | 299/33 |
| 4,113,123 A | * | 9/1978 | Jeffrey | 299/75 |
| 4,149,604 A | * | 4/1979 | Lockwood et al. | 299/13 |
| 4,240,665 A | * | 12/1980 | Hubbard et al. | 299/43 |
| 4,241,824 A | * | 12/1980 | Georg et al. | 198/745 |
| 4,265,587 A | * | 5/1981 | Clark | 172/273 |
| 4,415,295 A | * | 11/1983 | Werner et al. | 405/291 |

FOREIGN PATENT DOCUMENTS

| | | | | |
|---|---|---|---|---|
| DE | 260 408 A3 | | 9/1988 | |
| DE | 19721201 A1 | * | 11/1998 | E21C/35/12 |

OTHER PUBLICATIONS

Knitzschke and Kahmann: Mining of copper shale in the Sangerhausen district; Gluckauf 126 (1990) Nr. 11/12 pp. 538–547.

* cited by examiner

*Primary Examiner*—John Kreck
(74) *Attorney, Agent, or Firm*—Cook, Alex, McFarron, Manzo, Cummings & Mehler, Ltd.

(57) ABSTRACT

The extraction machine for underground ore extraction operations, with extraction of the extraction product by blasting has an advancing support equipment (11) and a face conveyor (18) coupled to it as well as at least one boring device (26) for the production of shot holes (23) and a loading device (27) to supply the face conveyor (18) with the blast rock loosened by blasting, whereby the boring device (26) and the loading device (27) are assigned to a common boring and loading machine (24), which can be driven along the face conveyor (18) at right angles to the direction of mining in the direction towards the rock face (20) running parallel to the direction of mining, or away from this.

11 Claims, 3 Drawing Sheets

MINING SYSTEM WITH DRILLING, LOADING, CONVEYOR, AND SUPPORT

The present invention relates to an extraction machine for underground ore extraction operations with extraction of the product by blasting, with an advancing support unit and a face conveyor coupled to it and with at least one boring device for the production of holes for explosive and a loading device for loading the conveyor with the blast rock loosened by blasting. The present invention further relates to a method for extracting output products in underground mining by blasting in the face with the use of an advancing support equipment and a face conveyor coupled to this and at least one boring device for the production of holes for explosive and a loading device for loading the face conveyor with the blast rock loosened by blasting.

An extraction machine for the extraction of ore-bearing rock using blasting is proposed in DE 197 21 201 A1, in which the blast rock is conveyed out of the extraction face with the aid of a face conveyor. The face conveyor comprises here a chain scraper conveyor, whose return run is arranged sideways at a distance from its conveying run, behind it and whose driven and endless scraper chain, reversible over chain wheels into conveying and return runs is guided in a chain guide channel, whereby the two chain guide channels are arranged at a distance sideways from each other. On the face conveyor itself is arranged a boring device which can move along the face, which bores the necessary holes in the face, running at right angles to the direction of mining. The loading of the conveyor with the blast rock loosened by the blasting is effected by shifting the conveyor so that the conveyor pan, wedge shaped toward the face, facing the working face is pushed along the ground into the loosened blast rock, which then comes into the working area of the moving scrapers, and is taken away out of the face.

The boring of shot holes, which are made in the direction of the mining into the rock face running at right angles to this, makes it difficult if not entirely impossible to maintain a level floor or roof. This leads to the condition that the blast rock loosened by the blasting can be loaded onto the then advanced conveyor only with difficulty and with relatively large loss, since the floor is so uneven that a large part of the loosened blast rock remains under the wedge shaped loading pans.

A boring wagon for application in a generic extraction machine is known from DE-B-970 161, which is withdrawn onto an auxiliary travelling frame after boring the shot holes, so as thereby to provide sufficient space for a face shovelling loader to load the loosened blast rock and then to transport it to a loading band beginning behind the face shovelling loader.

It is the aim of the present invention to produce an extraction machine of the construction described in the opening paragraph, with which it is possible to achieve a very smooth and even quality of the roof and floor ore extraction operations and therewith actually to extract the greatest possible proportion of the loosened blast rock. In this the expenditure on machinery should be kept low and the machines brought into application are exploited as fully as possible.

Accordingly the present invention is directed to an extraction machine as described in the opening paragraph of the present specification in which, the boring device and the loading device are assigned to a boring and loading machine, which can travel along the face conveyor at right angles to the direction of mining towards the rock face running parallel to the direction of mining or away from this.

Differently from the mining method proposed in DE 197 21 201, the necessary shot holes for the blasting are not bored into the face parallel to the mining direction but at right angles to the direction of mining into a comparatively narrow rock face, which runs parallel to the direction of mining. To this end the boring machine provided with the boring device is advanced along the face conveyor into the face until the shot holes can be bored. After the boring the whole boring pattern, the boring equipment can be withdrawn from the rock face until it is again in the safe zone when, after the setting of the blast charges, blasting occurs. During the setting of the blasting charges the boring equipment can be exchanged for the loading equipment or can be so converted to a loading equipment that the loading device can be applied, so that the machine provided with the loading equipment can be advanced without delay after the explosion is complete so as to convey the blast rock loosened by the explosion using the loading equipment onto the face conveyor.

The arrangement of the bored holes, which are bored at right angles to the direction of mining permit, with a suitable choice of a matching boring pattern, a very even floor and roof to be obtained, which substantially eases the advance of the conveyor and the stepping of the mining machine. Furthermore with this method of operation the greater part of the loosened blast rock is actually loaded onto the face conveyor and extracted. The boring device and/or the loading device is/are preferably demountably arranged on a common boring and loading machine. The boring device can be removed from the common boring and loading machine after boring the shot holes and stored temporarily at a suitable position, whilst the equipment with the loading device loads the loosened blast rock onto the conveyor.

Especially on comparatively short faces, where the distance from the face end side path to the rock face is not more than 100 m, it can be expedient if the boring device and the loading device are each arranged on separate movable boring or loading machines. In this configuration it is not necessary after each withdrawal of the equipment fitted out with the boring or loading equipment for this to be converted to the other device in each case, so that no conversion times delay the advance of the mining.

An advantageous arrangement results if the loading device has a side loading shovel, whereby the boring unit can be demountably connected onto the loading device.

The face conveyor can be equipped with at least one additional boring device which can move in its longitudinal direction, with a height adjustable boring carriage with which in addition to the borings made in the longitudinal direction of the face shot holes can also be bored in the direction of mining. By this simultaneous boring both parallel to the longitudinal direction of the face from the rock face out and also at right angles to it, the time which the boring process takes overall is shortened considerably. It is especially expedient in this method of operation to cause the boring device boring parallel to the longitudinal direction of the face on the travelling boring equipment to bore the holes in the floor and the roof of the rock face, whilst the additional boring device makes the shot holes between these "floor and roof" borings.

The support equipment is preferably provided with pivoting explosion protection shields arranged on the roof caps of its support frames, which are pivoted down into their protecting position before the firing is carried out, so that stones loosened by the firing cannot be projected into the support frame, where they otherwise could damage sensitive equipment within it. Alternatively or supplementary to this the face conveyor can also be provided on its goaf side with vertically adjustable explosion protecting plates, movable in the longitudinal direction of the face.

An advantageous configuration of the invention results if the support equipment is provided with at least one arrangement arranged below the cap of one of its support frames for accepting the boring device and/or the loading device. The demountable boring or loading device from the boring or loading machine can be safely stored on this accepting arrangement between times, whilst the boring and loading machine is either loading the loosened blast rock onto the face conveyor or boring the shot holes. Advantageously several accepting arrangements are arranged, distributed over the mining or face length on the support equipment, so that for conversion the boring and loading machine has only to travel back to the next accepting arrangement for the boring and/or loading device, which is then naturally so far distant from the firing site at the time, that the boring and loading machine is in the safe region of the face during firing.

The boring and/or loading machine has preferably independently driven caterpillar tracks, with which it can travel back and forth immediately on the ground and thus requires no dedicated rail track or similar. In order to improve the loading performance still further, the loading device can have a loading shovel with freeing chisels which preferably can also be activated. It is possible with the aid of the freeing chisels, to separate ridges, unevennesses or similar from the floor still protruding after firing and thus create a practically even floor.

In an advantageous development of the invention the support frames of the support arrangement can be provided with at least one goaf side gob shield with at least one closable opening and associated roof boring device and the support arrangement can be equipped with a goaf side roof fall conveyor. It is then possible via the openings in the roof cap or gob shield of the support frame also to cause the breaking off of mineral rock in the roof either directly with the upwards boring devices or by firing and for instance with the aid of the roof fall conveyor to transport it away. In addition to the face side extraction goaf side extraction can thus also occur which substantially increases the total quantity conveyed.

A second aspect of the present invention is directed to a method of mining using the machine described above, in which:

- shot holes are bored in the rock face at right angles to the direction of mining and essentially parallel to the longitudinal direction of the face using the boring device connected to the boring and loading machine;
- the boring and loading machine together with the boring device is driven back along the face conveyor to a safe distance from the firing point and re-equipped with the loading device, whilst the firing preparations are made;
- following the completion of firing the boring and loading machine, equipped with the loading device is driven forward, in order to load the loosened blast rock onto the face conveyor running parallel to the path of the loading device;
- the boring and loading machine with the loading device is then driven back and re-equipped with the boring device, so as then to be driven forward to the (new) rock face, where then new shot holes are bored;
- these steps are repeated until the face has been mined over its whole mining length to the depth of the rock face;
- the support arrangement, complete with the face conveyor is then moved forward.

An especially advantageous development of the method according to the invention, which achieves independent inventive significance and which can also find application in other forms of long face mining, results if the extraction product breaking out from the roof following the advance of the support equipment is taken away through extraction funnels, drop holes or similar arranged in the floor, into extraction tracks, provided with conveyor devices, extended below the face. It has been shown that in cases in which this pure roof fall exploitation, in which extraction tracks are extended below the ore bed and then extraction funnels or similar are driven through their covers into the bed, permit the extraction of the whole ore bed down to only a comparatively small percentage, by the previous production of a hollow space through the proceeding longitudinal face mining above the extraction tracks the mining can be essentially complete. This is because after the passage of the face, the ore bearing rock can break off into a large pillar-less hollow space and thereby disintegrates into comparatively small pieces, whose extraction through the extraction funnel, drop holes or similar presents no problem. In cases where for instance using the known caving method, seams with a large thickness of 30 or more meters could be mined only to a height of some 10 m and even this could only be partly mined, the combination according to the invention of roof fall exploitation and advancing long face mining permits a practically complete extraction of even very thick seams.

The extraction tracks are advantageously extended parallel to the mining direction of the face, below it. This can occur at two or more levels below the face, if the seam to be mined is especially thick. It is expedient for the extraction tracks to be extended before the long face mining on the face is complete.

Preferably the face can be developed from both face ends using two boring and loading machines at the same time, whereby then the boring and loading machines, following the mining of the whole mining length, are driven back completely to their starting points on the roadway, before the support equipment including the face conveyor is moved. The explosion protective shields arranged on the support frames of the support equipment in the firing area are activated before the firing, so that rock loosened in the firing cannot be thrown into the region of the support frames. For an especially clean bed it has been proved to be advantageous if the boring device at the floor and at the roof bores a multiplicity of closely spaced shot holes.

The extraction product remaining in the roof can be loosened by boring and/or blasting and taken up and conveyed away by means of a roof fall conveyor drawn behind the support equipment and/or via extraction openings in the floor into extraction tracks extended under it.

An extraction machine made in accordance with the present invention will be described herein below in relation to the accompanying drawings, in which.

Figure 1:
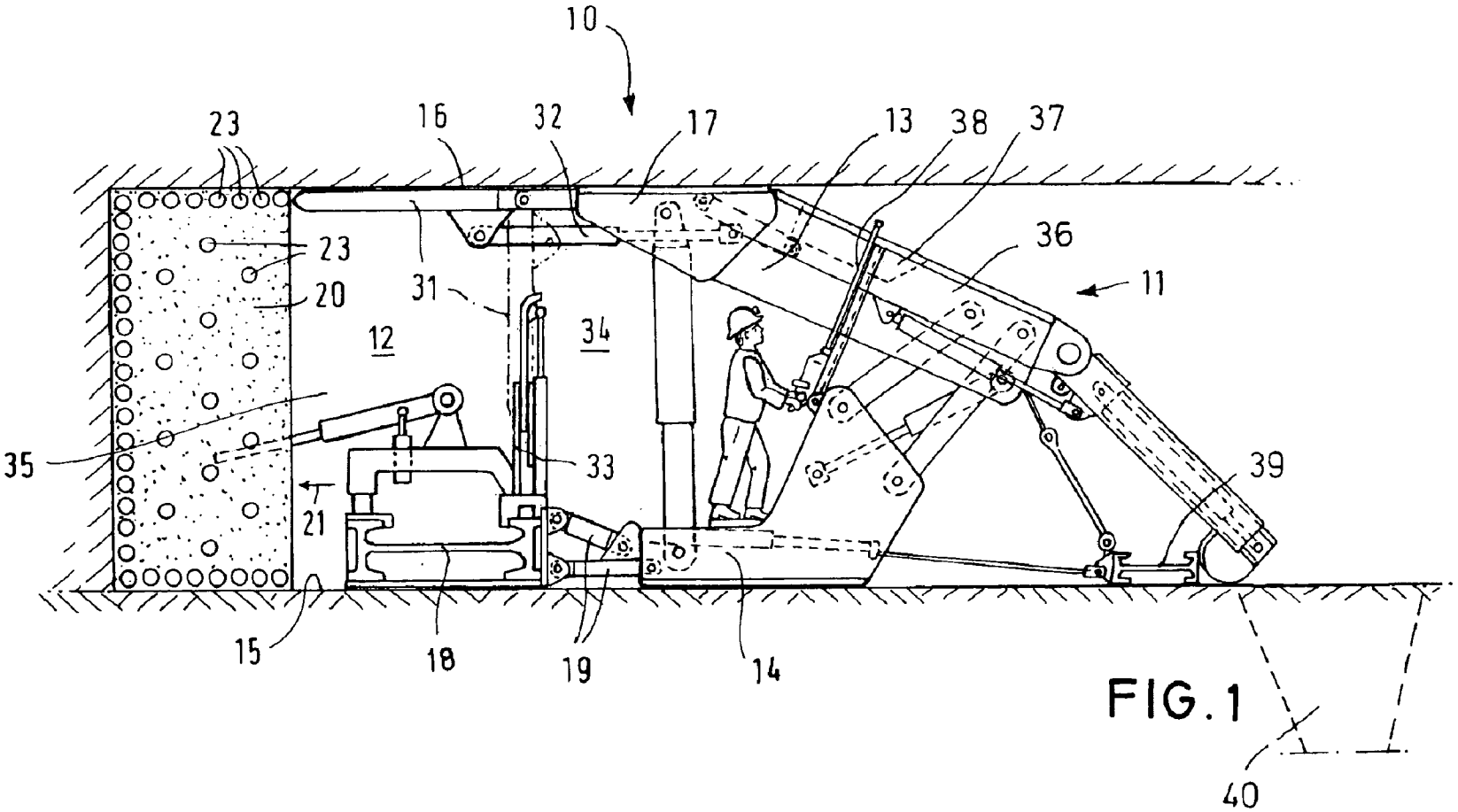
FIG. 1 shows a side view of one of its support frames in the region of the rock face of an extraction machine according to the present invention.

The extraction machine 10 for underground mining operations shown in the drawings serves for the extraction of copper ore, which is extracted by explosive operations.

The extraction machine 10 has previously proposed support equipment 11 with a multiplicity of support frames 13 arranged adjacent to each other at the face 12, which support themselves on the floor 15 by their skids 14 and they engage the roof 16 with their roof end caps 17. To convey away the copper ore cut out a face conveyor 18 is connected jointed and movable by hydraulic cylinders 19 to the skids 14 of the support frame, as has also been previously proposed in the advancing support frame.

As can be well seen from the drawing the mining of the copper ore to be loosened by explosive is effected from a rock face 20, which runs parallel to the direction of mining 21 and thus at right angles to the longitudinal direction 22 of the face.

Figure 2:
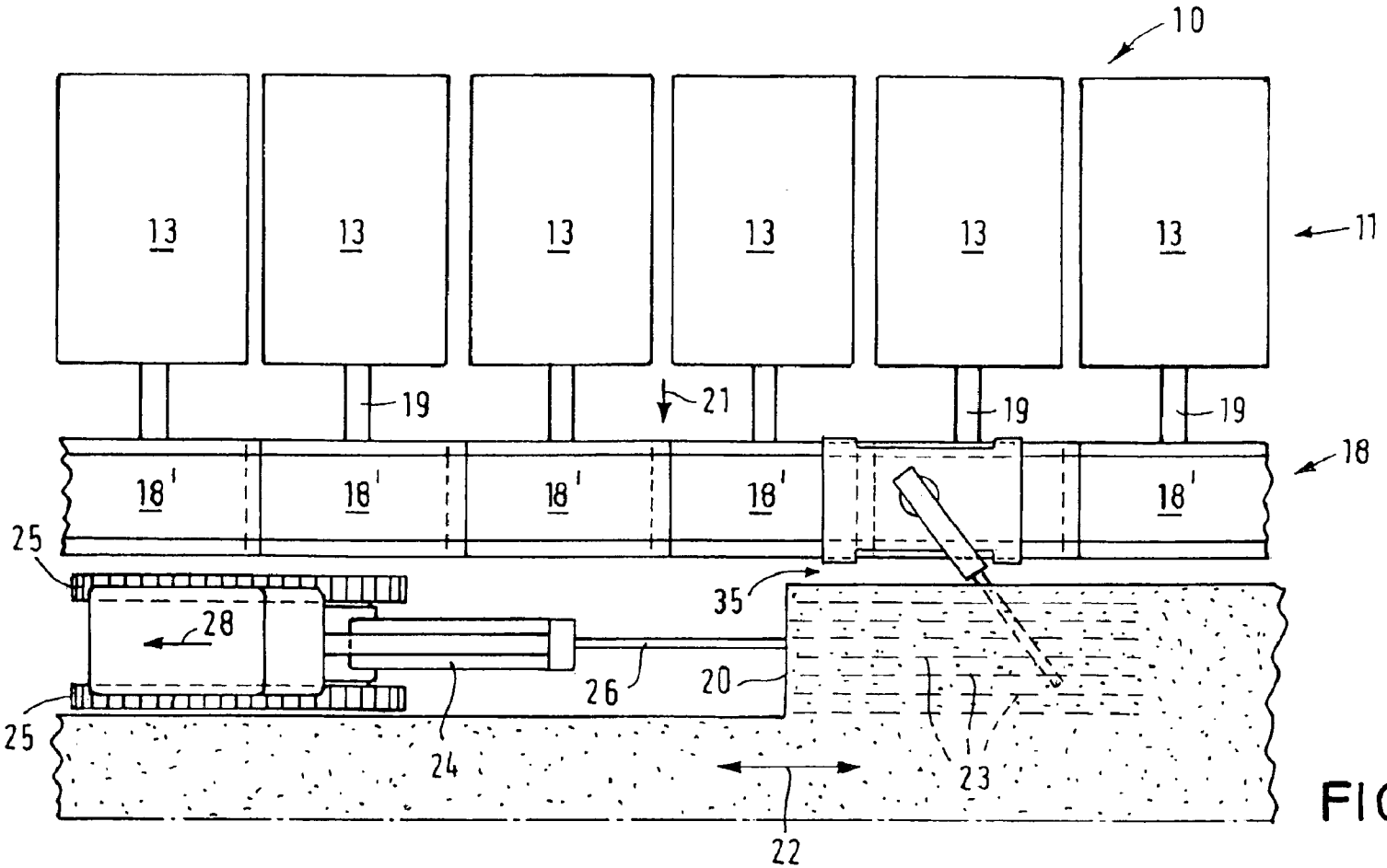
FIG. 2 shows a greatly simplified representation in a plan view of the extraction machine to illustrate a step in the method.
Figure 3:
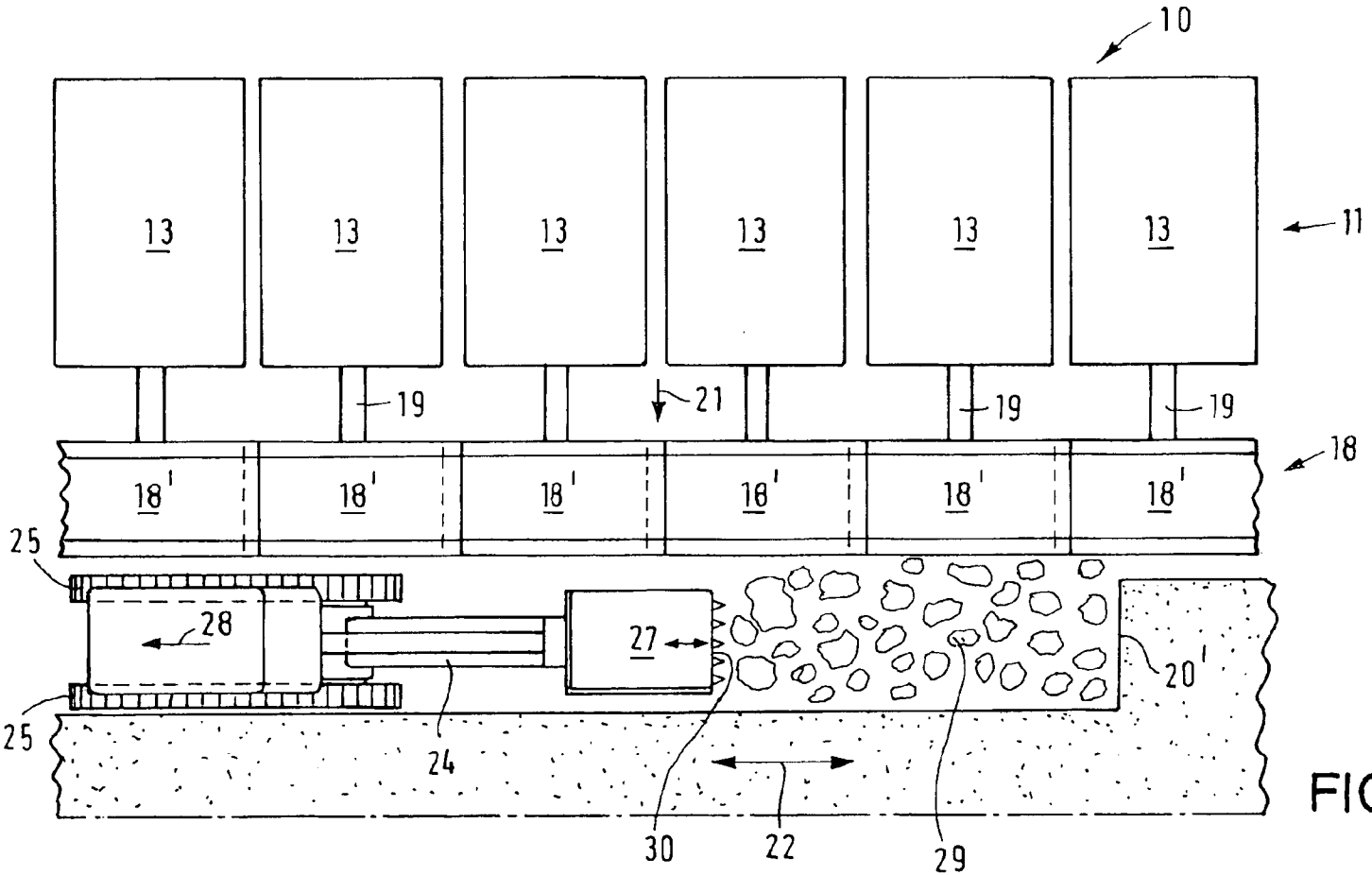
FIG. 3 shows the view of FIG. 2 in a subsequent step in the method.

For the production of the shot holes 23 in the rock face 20 and also for loading the loosened blast rock onto the face conveyor 18 the extraction equipment is provided with a common boring and loading machine 24, which is only shown schematically in FIG. 2 and FIG. 3. The boring and loading machine 24 has independently driven caterpillar tracks 25, onto which is connected a boring device 26 to produce the shot holes and a loading device 27 is connected for the loading of the loosened copper ore.

FIG. 2 shows the step in the method in which the shot holes are produced in the rock face 20 according to a prescribed pattern, which can be as seen indicated in FIG. 1. The boring and loading machine 24 is provided with the boring device 26 for this and stationed in a position in front of the rock face 20, from where the borings 23, possibly with short forward and backward movements of the boring and loading machine can easily be made. When all the borings have been completed, the boring and loading machine is driven away by its machine driver back in the direction of the arrow 28 far enough from the rock face such that it is in a safe place during the firing which follows.

Whilst the shot holes are being prepared with explosive for the blasting, at the distant position the boring device 26 is demounted from the boring and loading machine and accepted for intermediate storage on a (not shown) accepting arrangement, which is arranged on one of the support frames 13 below the roof cap. The boring and loading machine is or will be then provided with the loading device before it, following the firing, advances to the then loosened blast rock 29 and loads this with its loading shovel 30 onto the adjacent face conveyor 28 to the side.

To protect the support frames and the equipment within them during firing, pivoting explosion protection shields 31 are arranged on the roof caps 17 of the support frames, which before firing can be pivoted downwards with the aid of a cylinder 32 into the position shown dashed in FIG. 1, in which they lie against abutment plates 33 arranged on the face conveyor 18 on the goaf side and thus separate the endangered region 34 of the support frame 13 from the firing area 35.

Expediently the loading of the loosened blast rock 29 is carried out with the explosion protection shields still pivoted down, so that ore thrown by the side loading shovel 30 of the loading device of the boring and loading machine onto the face conveyor 12 also cannot be thrown over the conveyor on the goaf side, but are held back by the explosion protection shield and the abutment plates and in any case fall onto the conveyor.

When the loosened blast rock is completely transferred to the conveyor, the boring and loading machine travels back again to the position, at which the boring device has been stored during the firing and loading process. Following its fresh assembly the equipment 24 can again be driven forward up to the new rock face 20', into which shot holes are bored afresh.

It is understood that especially with a greater length of the face, several accepting arrangements for the boring device are arranged distributed amongst the support equipment 11 so that the boring and loading machine does not have to travel back over the whole length of the face as mining progresses, but only as far as the last accepting arrangement, which is at a safe distance from the firing area.

The described method according to the invention and the equipment provided for it facilitates an especially effective extraction of the ore using an explosive process, whereby owing to the especial position of the rock face at right angles to the longitudinal direction of the face it is especially possible using a suitable arrangement of the shot holes to obtain even breaking edges on firing on the floor, roof and on the side of the rock face towards the stope face. To this end it is possible—as shown in FIG. 1—for a shot hole pattern to be bored, in which a multiplicity of borings are bored close to each other in the upper, lower and side regions of the rock face, which then break off at these positions almost in a straight line. Remaining unevenness on the floor can be smoothed out with the help of the loading device, for which it is provided with freeing chisels on its loading shovels, which can preferably also be active and which thereby are able to chisel the floor largely smooth during loading.

In addition to the extraction by face mining previously described, ore can also be extracted by roof fall exploitation using the equipment and the method according to the invention as is shown in FIG. 1. For this purpose the support frames 13 of the support equipment 11 are provided with goaf side gob shields 36 with in each case at least one closable opening 37 and associated roof boring devices 38 and the support equipment 11 is equipped with a goaf side roof fall conveyor 39. Using the roof boring devices bored holes can be bored into the ore bearing rock visible in the roof and then charged with explosive, in the event that it does not collapse of its own accord. The conveying away of the ore extracted from the roof can be effected using the roof fall conveyor 39, onto which the extracted product falls from the gob shields 36. In the case of especially deep veins, of which following the passage of the face mining a large part remains in the roof and then breaks into the hollow space extending behind the face mining, the roof fall conveyor alone is in general not sufficient to convey the ore bearing rock falling behind the support equipment. In such cases extraction paths can be extended below the face 12 running in the direction of the mining, in whose covers extraction funnels indicated by dashed lines referenced 40 are produced. The collapsing ore bearing rock can then be drawn off through these extraction funnels and transported away using path conveyors arranged in the extraction paths. With favourable conditions almost complete mining can be attained even from seams with depths above 30 or more meters. To this end the extraction paths can also be extended in several stages below the hollow space created from the face.

The invention is not limited to the embodiment shown and described, but many modifications and extensions are possible without departing from the scope of the invention. Thus for instance in addition to the boring device operating at right angles to the direction of mining, one or more additional boring devices can be provided on the face conveyor, which produce additional borings in the mining face, which shortens the overall boring time for the production of the shot holes.

Instead of or additionally to the pivoting explosion protection shields arranged on the support frames the face conveyor can be provided with vertically adjustable explosion protection plates, movable in the longitudinal direction of the face, on its goaf side, which are configured similarly to the abutment plates 33 and prevent the ingress of stones released by explosion into the endangered area 34.

Especially on short faces, whose length can be travelled in a comparatively short time, it can be expedient, instead of a common boring and loading machine, to arrange the boring device and the loading device each on a separate boring equipment and loading equipment, which then is driven from its application site at the rock face back along the roadway, so as to be replaced by the other equipment. The re-equipment work can hereby be omitted, which is necessary in the combined boring and loading machine.

What is claimed is:

1. An extraction system for underground ore extraction operations with extraction of the ore by blasting, with advancing support equipment and a face conveyor coupled to it and with at least one boring device for the production of holes for explosive and a loading device for loading the conveyor with the blast rock loosened by blasting, characterised in that the boring device and the loading device are assigned to a boring and loading machine, which can travel along the face conveyor at right angles to the direction of mining towards the rock face running parallel to the direction of mining or away from this, wherein the support equipment includes a support frame and the support frame has at least one goaf side gob shield.

2. An extraction system according to claim 1, characterised in that the boring device and/or the loading device is/are demountably arranged on a common boring and loading machine.

3. An extraction system according to claim 1, characterised in that the boring device and the loading device are individually and separately mobile boring and loading machines.

4. An extraction system according to claim 1, characterised in that the loading device has a side loading shovel and that the boring device is connected demountably to the loading device.

5. An extraction system according to claim 1, characterised in that at least one additional boring device above the face conveyor mobile in its longitudinal direction is provided, with a height adjustable boring carriage.

6. An extraction machine according to claim 1, in which the support equipment is provided with pivoting explosion protection shields arranged on the roof caps of its support frames.

7. An extraction machine according to claim 1, in which the face conveyor is provided on its goaf side with vertically adjustable explosion protection abutment plates, movable in the longitudinal direction of the face.

8. An extraction machine according to claim 1, in which the boring and loading machine has independently driven caterpillar tracks.

9. An extraction machine according to claim 1, in which the loading device has a loading shovel with freeing chisels.

10. An extraction machine according to claim 9, in which the freeing chisels can be activated.

11. An extraction machine according to claim 1, wherein the at least one goaf side gob shield has at least one closable opening and wherein the support frames of the support equipment include at least one associated roof boring device, and a goaf side roof fail conveyor.

* * * * *